United States Patent [19]

Taguchi

[11] Patent Number: 4,720,865

[45] Date of Patent: Jan. 19, 1988

[54] MULTI-PULSE TYPE VOCODER

[75] Inventor: Tetsu Taguchi, Tokyo, Japan

[73] Assignee: NEC Corporation, Tokyo, Japan

[21] Appl. No.: 625,055

[22] Filed: Jun. 26, 1984

[30] Foreign Application Priority Data

Jun. 27, 1983 [JP] Japan ..... 58-115538
Aug. 15, 1983 [JP] Japan ..... 58-149007

[51] Int. Cl.[4] ..... G10L 5/00
[52] U.S. Cl. ..... 381/49
[58] Field of Search ..... 381/30–50

[56] References Cited

U.S. PATENT DOCUMENTS 4,472,832 9/1984 Atal et al. ..... 381/40
4,516,259 5/1985 Yato et al. ..... 381/36
4,544,919 10/1985 Gerson ..... 381/41

OTHER PUBLICATIONS

Atal et al., "A New Model of LPC Excitation for Producing Natural Sounding Speech at Low Bit Rates", IEEE Proc. ICASSP 1982, pp. 614–617.

*Primary Examiner*—Emanuel S. Kemeny
*Attorney, Agent, or Firm*—Sughrue, Mion, Zinn, Macpeak & Seas

[57] ABSTRACT

A multi-pulse type vocoder extracts spectrum information of an input speech signal in one analysis frame. The impulse response h(n) of an inverse filter specified by the extracted spectrum information is then developed. A cross-correlation function $\phi_{hx}(m_i)$ is developed from the input speech signal X(n) and the impulse response h(n) at a time point $m_i$. In addition, an autocorrelation function $R_{hh}(n)$ of h(n) is developed. A multi-pulse calculator is provided to determine the multi-pulses from the cross-correlation function $\phi_{hx}(m_i)$. The multi-pulse calculator is also provided with means for determining the portion of $\phi_{hx}$ most similar to the function $R_{hh}(n)$, and for correcting the function $\phi_{hx}$ by subtracting the function $R_{hh}(n)$ from the thus determined portion of $\phi_{hx}(m_i)$.

9 Claims, 21 Drawing Figures

FIG.2B
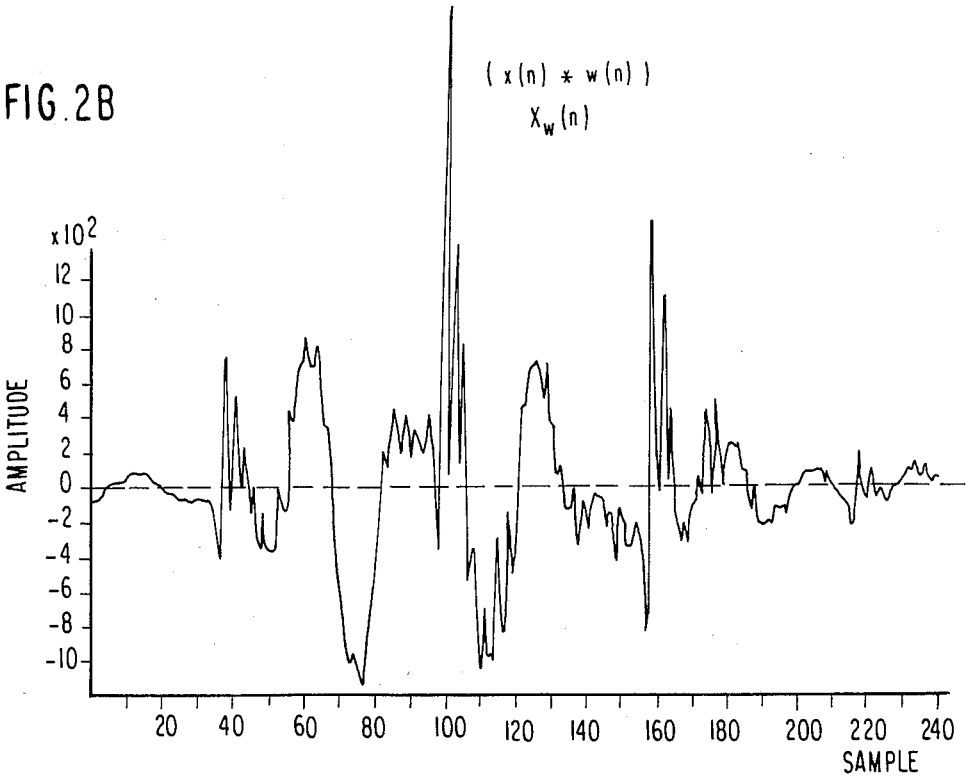
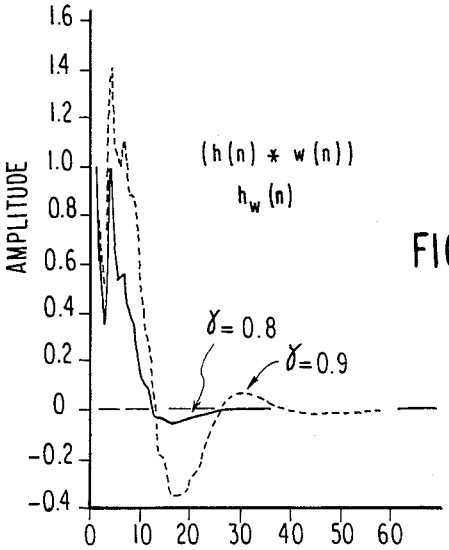
FIG.2C
FIG.2E
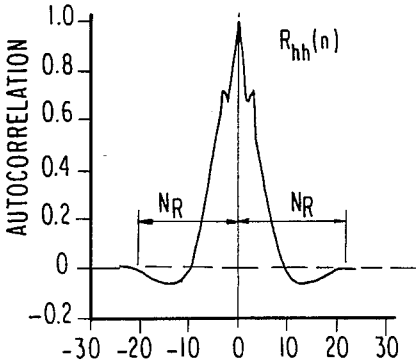
FIG.2D
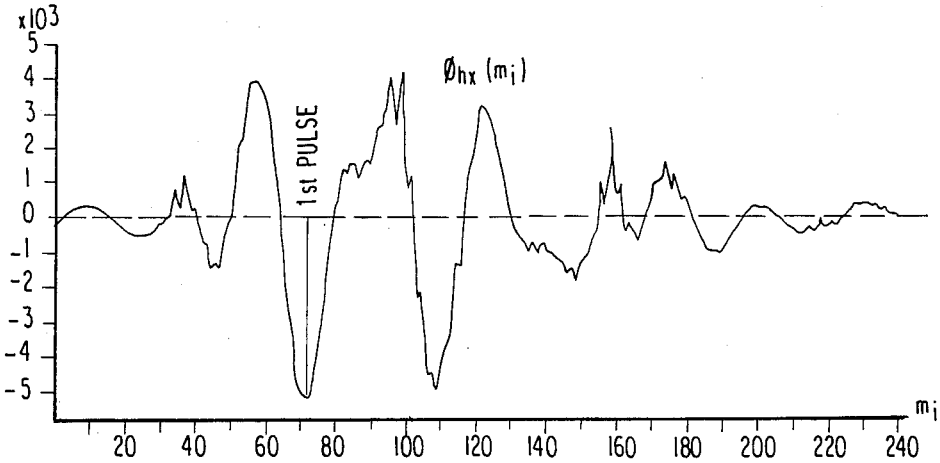

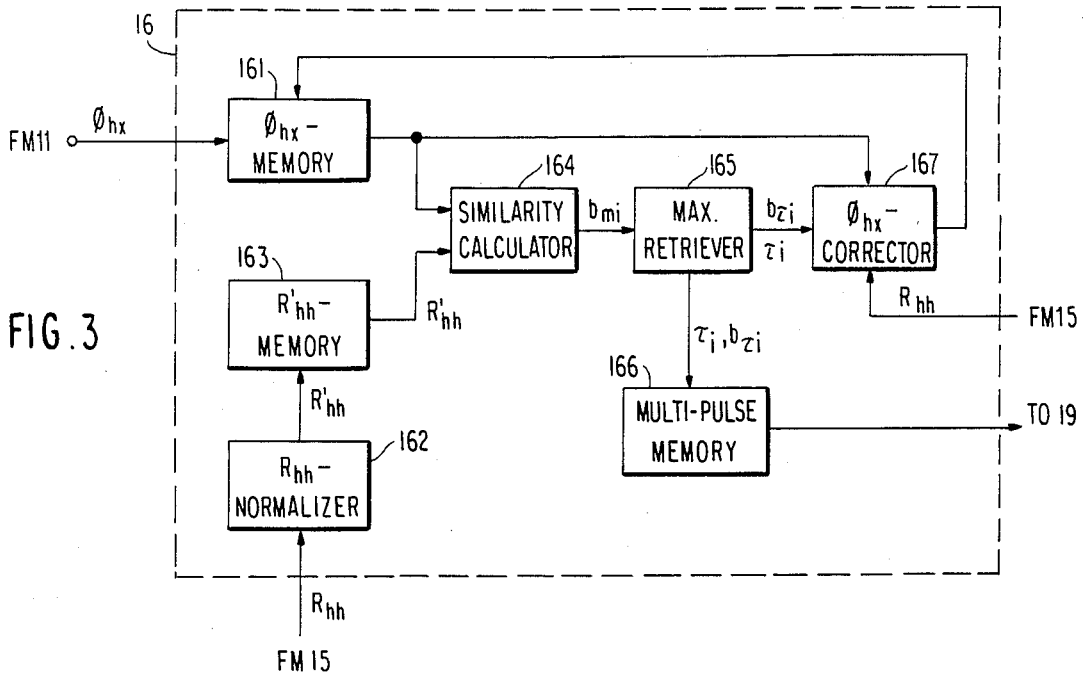
FIG. 3
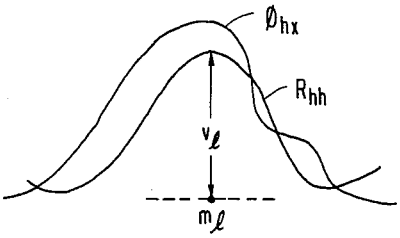
FIG. 4
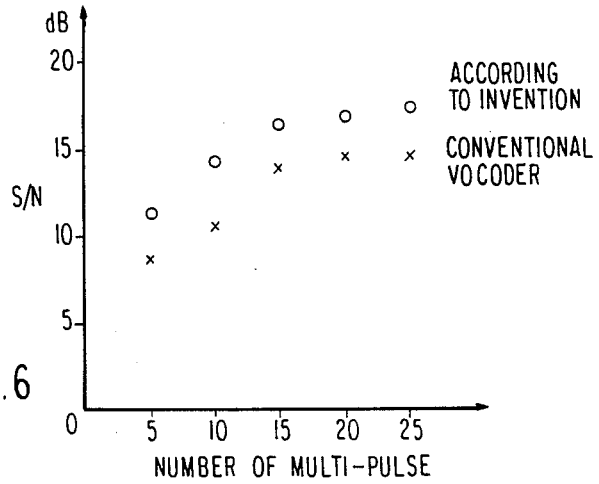
FIG. 6
FIG. 7
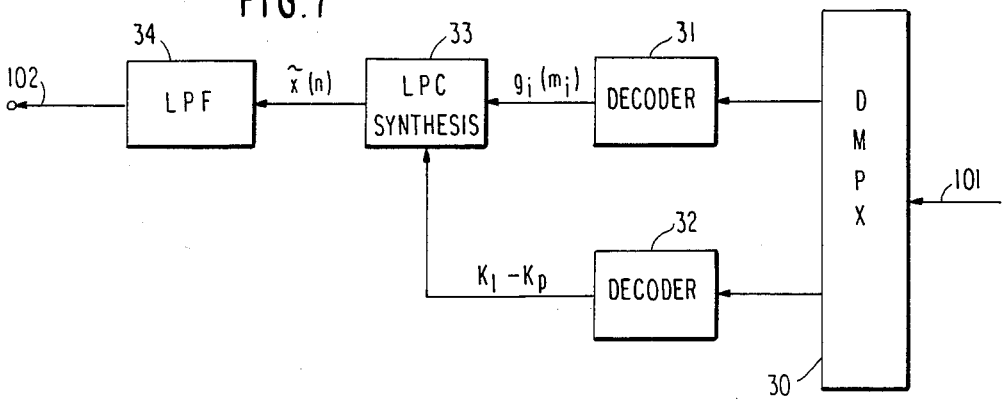

MULTI-PULSE TYPE VOCODER

BACKGROUND OF THE INVENTION

This invention relates to a multi-pulse type vocoder.

There is known a type of vocoder which analyzes an input speech signal to extract, at the analysis side, spectrum envelope information and excitation source information, and reproduces the input speech signal, on the synthesis side, on the basis of this speech information transmitted through a transmission line.

The spectrum envelope information represents spectrum distribution information of the vocal track and is normally expressed by an LPC coefficient such as the $\alpha$ parameter and K parameter. The excitation source information indicates a microstructure of the spectrum envelope and is known as the residual signal obtained through removing the spectrum distribution information from the input speech signal, including strength of an excitation source, pitch period and voiced-unvoiced information of the input speech signal. The spectrum envelope information and the excitation source information are utilized as a coefficient and an excitation source for the LPC synthesizer based on an all-pole type digital filter.

A conventional LPC vocoder is capable of synthesizing speech even at a low bit rate of about 4 Kb or below. However, high quality speech synthesis is hard to attain even at high bit rates due to the following reason. In the conventional vocoder, a voiced sound is approximated in a single impulse train corresponding to the pitch period extracted on the analysis side. An unvoiced sound is also approximated as white noise at a random period. Therefore, the excitation source information of an input speech signal is not extracted conscientiously; that is, the waveform information of the input speech signal is not practically extracted.

The recently developed multi-pulse type vocoder carries out an analysis and a synthesis based on waveform information in order to eliminate the above problem. For more information on the multi-pulse type vocoder, reference is made to the report by Bishnu S. Atal and Joel R. Remde, "A NEW MODEL OF LPC EXCITATION FOR PRODUCING NATURAL-SOUNDING SPEECH AT LOW BIT RATES", PROC. ICASSP 82, pp. 614 to 617 (1982).

In this vocoder, an excitation source series is expressed by a multi-pulse excitation source consisting of a plurality of impulse series (multi-pulse). The multi-pulse is developed through the so-called A-b-S (Analysis-by-Synthesis) procedure which will be briefly described hereinafter.

The LPC coefficient of an input speech signal X(n) obtainable at each of the analysis frames is supplied as the filter coefficient of the LPC synthesizer (digital filter). An excitation source series V(n) consisting of a plurality of impulse series, namely a multi-pulse, is supplied to the LPC synthesizer as the excitation source. Then, the difference between a synthesized signal X(n) obtained in the LPC synthesizer and the input speech signal X(n), i.e. an error signal e(n), is obtained using a subtracter. Thereafter an aural weighting factor is applied to the error signal in an aural weighter. Next, the excitation source series V(n) is determined in a square error minimizer so that a cumulative square sum (square error) of the weighted error signal in the frame will be minimized. Such a multi-pulse determination according to the A-b-S procedure is repeated for each pulse, thus determining optimum position and amplitude of the multi-pulse.

The multi-pulse type vocoder described above may realize a high quality speech synthesis using low-bit transmission. However, the number of arithmetic operations is unavoidably huge due to the A-b-S procedure.

In view of the above situation, a procedure for efficiently calculating an optimum multi-pulse according to a correlation operation has been proposed. Reference is made to a report by K. Ozawa, T. Araseki and S. Ono, "EXAMINATION ON MULTI-PULSE DRIVING SPEECH CODING PROCEDURE", Meeting for Study on Communication System, Institute of Electronics and Communication Engineers of Japan, Mar. 23, 1983, CAS82-202, CS82-161. Further, the technique is disclosed in U.S. patent application Ser. No. 565,804 filed Dec. 27, 1983 by Kazumori Ozawa et al, assignors to the present assignee. An algorithm of this procedure is as follows:

Assuming now an excitation source pulse is present in k pieces in one analysis frame, the first pulse is at a time position $m_i$ from the frame end, and its amplitude is $g_i$. Then an excitation source d(n) of the LPC synthesis filter is given by the following expression (1):

$$d(n) = \sum_{i=1}^{k} g_i \cdot \delta_{n'} m_i \tag{1}$$

where $\delta_n$, $m_i$ are Kronecker's delta functions, and $\delta_n$, $m_i = 1$ $(n = m_1)$, $\delta_n$, $m_i = 0$ $(n \neq m_i)$.

LPC synthesis filter is driven by the excitation source d(n) and outputs a synthesis signal x(n). For example, an all-pole digital filter may be used as the LPC synthesis filter, and when its transmission function is expressed by an impulse response h(n) $(1 \leqq n \geqq N_h)$, where $N_h$ is a predetermined number, the synthesis signal x(n) can be given by the following expression.

$$\tilde{x}(n) = \sum_{i=1}^{N} d(l) \cdot h(n - l) \tag{2}$$

where N denotes the last number of sample numbers in the analysis frame, and d(l) denotes the l-the pulse of d(n) in the expression (1).

Next, a weighted error $e_w(n)$ obtained through applying the aural weighting to the error between the signals x(n) and x(n) will be indicated by the expression (3).

$$e_w(n) = \{x(n) - x(n)\} w(n) \tag{3}$$

Further, the square error can be indicated by the expression (4) by using the expression (3).

$$\sum_{n=1}^{N} e^2_w(n) = \sum_{n=1}^{N} [\{x(n) - \tilde{x}(n)\} \quad w(n)]^2 \tag{4}$$

The multi-pulse as an optimum excitation source pulse series is obtainable by obtaining $g_i$ which minimizes the expression (4), and $g_i$ is derived from the following expression (5) from the above expressions (1), (2) and (4).

$$g_i(m_i) = \sum_{n=1}^{N} x_w(n) \cdot h_w(n - m_i) - \tag{5}$$

-continued $$\sum_{l=1}^{i-1}\left[g_l \sum_{n=1}^{N} h_w(n-m_l), h_w(n-m_i)\right] / \sum_{n=1}^{N} h_w(n-m_i) \cdot h_w(n-m_i)$$

where $x_w(n)$ indicates x(n) x w(n), and $h_w(n)$ indicates h(n)x w(n). The first term of the numerator on the right side of the expression (5) indicates a cross-correlation function $\phi_{hx}(m_i)$ at time lag $m_i$ between $x_w(n)$ and $h_w(n)$, and $$\sum_{n=1}^{N} h_w(n-m_l) \cdot h_w(n-m_i)$$

of the second term indicates a covariance function $\phi_{hh}(m_l, m_i)$ ($1 \leqq m_l, m_i \leqq N$) of $h_w(n)$. The covariance function $\phi_{hh}(m_l, m_i)$ is equal to an autocorrelation function $R_{hh}(|m_l = m_i|)$. Therefore, expression (5) can be represented by the following expression (6).

$$g_i(m_i) = \frac{\phi_{hx}(m_i) - \sum_{l=1}^{i-1} g_l \cdot R_{hh}(|m_l - m_i|)}{R_{hh}(o)} \quad (6)$$

According to the expression (6), the i-th multi-pulse will be determined as a function of a maximum value and a time position of $g_i(m_i)$.

According to such algorithm, the multi-pulse can be developed through the calculation of the cross-correlation function and autocorrelation function. Therefore, it can be substantially simplified, and the number of arithmetic operations can be decreased sharply.

Be that as it may, this improved multi-pulse type vocoder is still not free from the following problems.

In this algorithm, where the cross-correlation function $\phi_{hx}(m_i)$ and the autocorrelation function $R_{hh}$ are largely different in form at the time point, $m_i$, $\phi(m_i)$ does not necessarily decrease optimally, the pulse number increases unnecessarily in consequence, and the coding efficiency deteriorates.

According to the above-described algorithm, time position and amplitude of the multi-pulse are determined through the following procedure. First, the cross-correlation function $\phi_{hx}(m_i)$ between the input signal and the impulse response and the autocorrelation function $R_{hh}$ of the impulse response are developed. With a position of the first pulse constituting the multi-pulse at the time position $m_i$ whereat the absolute value of a waveform $\phi_{hx}(m_i)$ thus obtained is maximized, the pulse amplitude is determined as a value $\phi_{hx}(m_1)$ of $\phi_{hx}$ $(m_i)$ at the time position $m_1$. Next, an influential component due to the first pulse is removed from the waveform of $\phi_{hx}(m_i)$. This operation implies that the waveform of $R_{hh}$ (normalized) is multiplied by $\phi_{hx}(m_1)$ around the time position $m_1$ and then subtracted from the waveform of $\phi_{hx}(m_i)$. After the waveform of the correlation function in which the influential component due to the first pulse is removed, is thus obtained, the second position and amplitude are determined based on the waveform as in the above procedure. Thus, positions and amplitudes of the third, fourth, ...., l-th pulses are obtained through repeating such operation.

As described, according to the above correlation operation the influence of the pulse obtained prior thereto is removed by subtracting the autocorrelation function waveform $R_{hh}$ from the cross-correlation function waveform $\phi_{hx}$. However, the waveform of $\phi_{hx}(m_i)$ and the waveform of $R_{hh}$ of each pulse at the time position are not necessarily analogous with each other, which may exert an influence on other waveform portion of $\phi_{hx}(m_i)$ through subtraction. Therefore, an unnecessary pulse is capable of being determined as one of the multi-pulses, thus preventing an optimum information compression.

In a conventional vocoder, the number of the multi-pulses in one frame is predetermined to be between 4 and 16 on the basis of the bit rate. However, the pitch period of the female voice or the infant voice is relatively short, for example 2.5 mSEC. In this case when the frame period is 20 mSEC, the number of multi-pulses to be set in one frame must be at least eight. In such a case, where the number of pulses to be generated in the analysis frame is set at four, a synthesized speech includes a double pitch error, which may deteriorate the synthesized tone quality considerably. That is to say, the synthesized signal in this case is not regarded as conscientiously carried out based on the waveform information. Therefore, the tone quality of the synthesized speech involves a deterioration corresponding to the difference in pulse number as described.

SUMMARY OF THE INVENTION

Now, an object of this invention is to provide a multi-pulse type vocoder with a coding efficiency enhanced to realize a higher information compression.

Another object of this invention is to provide a multi-pulse type vocoder in which the operation is relatively simple and the coding efficiency is improved.

Still another object of this invention is to provide a multi-pulse type vocoder capable of obtaining a high quality synthesized speech independent of the pitch period of an input speech signal.

According to this invention, there is provided a multi-pulse type vocoder comprising means for extracting spectrum information of an input speech signal X(n) in one analysis frame; means for developing an impulse response h(n) of an inverse filter specified by the spectrum information; means for developing a cross-correlation function $\phi_{hx}(m_i)$ between X(n) and h(n) at a time lag $m_i$ within a predetermined range; means for developing an autocorrelation function $R_{hh}(n)$ of h(n); and multi-pulse calculating means including means for determining the amplitude and the time point of the multi-pulse based on $\phi_{hx}(m_i)$ and means for determining the most similar portion of the $\phi_{hx}$ waveform to the $R_{hh}(n)$ and for correcting the $\phi_{hx}$ by subtracting the $R_{hh}(n)$ from the determined portion of the $\phi_{hx}(m_i)$.

Other objects and features of this invention will be made clear from the following description with reference to the accompanying drawings.

BRIEF DESCRIPTION OF THE DRAWINGS

FIGS. 2A to 2E are drawings representing model signal waveform which is obtainable from each part of the block diagram shown in FIG. 1.

FIG. 3 is a detailed block diagram representing one example of a multi-pulse calculator 16 in FIG. 1.

FIG. 4 is a waveform drawing for describing a principle of this invention.

FIG. 6 is a drawing giving a measured example of S/N ratio of an output speech relative to an input speech, thereby showing an effect of this invention.

FIG. 7 is a block diagram of a synthesis side in this invention.

DETAILED DESCRIPTION OF THE PREFERRED EMBODIMENTS

Figure 1:
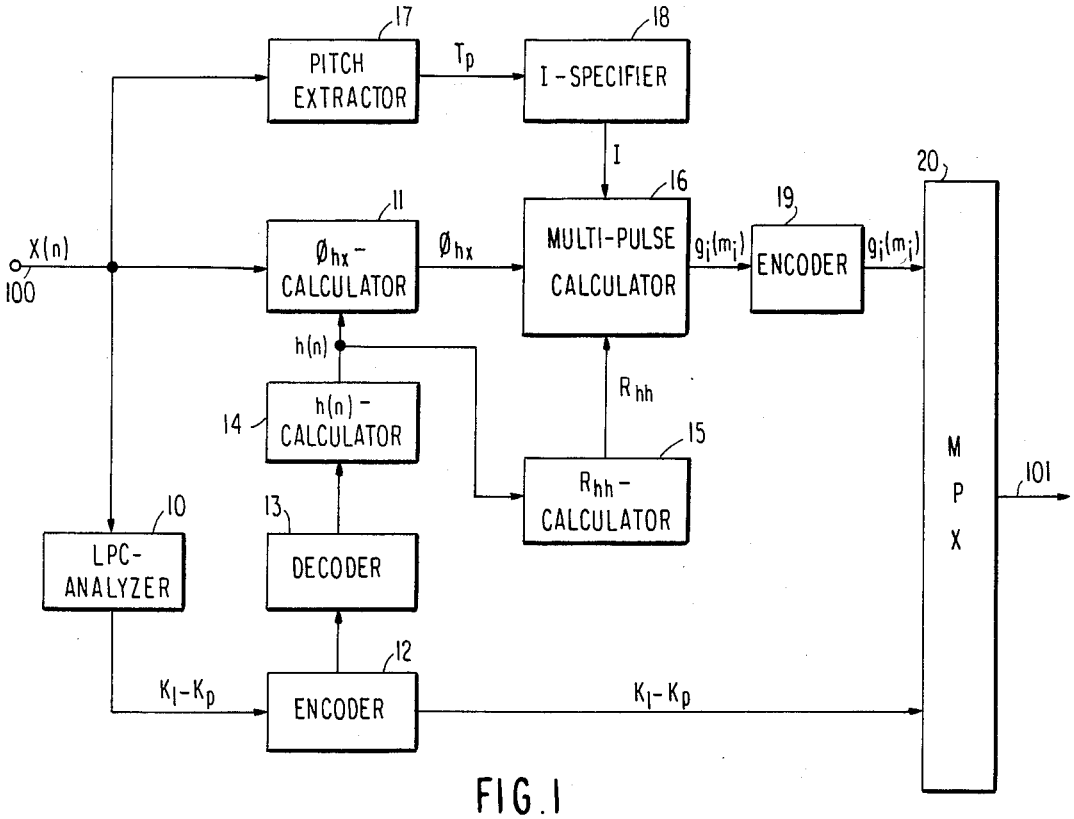
FIG. 1 is a basic block diagram representing an embodiment of this invention.

Referring to FIG. 1 representing the construction of an analysis side of a multi-pulse vocoder according to this invention, an input speech signal sampled at a predetermined sampling frequency is supplied to an input terminal 100 as a time series signal X(n) (n indicating a sampling number in an analysis frame and also signifying a time point from a start point of the frame) at every analysis frame (20 mSEC, for example). The input signal X(n) is supplied to an LPC analyser 10, a cross-correlation function calculator 11 and a pitch extractor 17.

The LPC analyzer 10 operates to perform the well-known LPC analysis to obtain an LPC coefficient such as the P-degree K parameter (partial autocorrelation coefficients $K_1$ to $K_p$). The K parameters are quantized in an encoder 12 and further decoded in a decoder 13. The K parameters $K_1$ to $K_p$ coded in the encoder 12 are sent to a transmission line 101 by way of a multiplexer 20. An impulse response h(n) of the inverse filter corresponding to a synthesis filter constructed by the decoded K parameters is calculated in an impulse response h(n) calculator 14. The reason why the K parameters used for the impulse response h(n) are first coded and then decoded is that a quantization distortion of the synthesis filter is corrected on the analysis side and thus a deterioration in tone quality is prevented by setting the total transfer function of the inverse filter on the analysis side and the synthesis filter on the synthesis side at "1".

The calculation of h(n) in the h(n) calculator 14 is as follows: LPC analysis is effected in the LPC analyzer 10 according to the so-called autocorrelation method to calculate, for example, K parameters ($K_1$ to $K_p$) up to P-degree, which are coded and decoded, and then supplied to the h(n) calculator 14. The h(n) calculator 14 obtains $\alpha$ parameters ($\alpha_1$ to $\alpha_p$) utilizing the K parameters, $K_1$ to $K_p$. The autocorrelation method and $\alpha$ parameter calculation are described in detail in a report by J. D. Markel, A. H. Gray, Jr., "LINEAR PREDICTION OF SPEECH", Springer-Verlag, 1976, particularly FIG. 3-1 and p50 to p59, and in U.S. Pat. No. 4,301,329, particularly FIG. 1.

The h(n) calculator 14 obtains an output when the impulse, namely amplitude "1" at n=0 and "0" at another n, is inputted to an all-pole filter using $\alpha$ parameters obtained as above, and characterized by the expression:

$$H(Z) = \frac{1}{1 - \sum_{i=1}^{p} \alpha_i Z^{-i}} \quad (i = 1, \ldots, p)$$

The impulse response h(n) thus developed is represented by the following expressions:

$$h(0)=1$$

$$h(1)=\alpha_1$$

$$h(2)=\alpha_2+\alpha_1 \cdot h(1)$$

$$h(3)=\alpha_3+\alpha_2 \cdot h(1)+\alpha_1 \cdot h(2)$$

$$h(4)=\alpha_4+\alpha_3 \cdot h(1)+\alpha_2 \cdot h(2)+\alpha h(3)$$

It is noted here that $\gamma^i \alpha_i$ using an attenuation coefficient $\gamma(0<\gamma<1)$ can be used instead of the above $\alpha_i$.

The cross-correlation function $\phi_{hx}$ calculator 11 develops $\phi_{hx}(m_i)$ in the expression (6) from the input signal X(n) and the impulse response h(n). From the expression (5), $\phi_{hx}(m_i)$ is expressed as:

$$\phi_{hx}(m_i) = \sum_{n=1}^{N} X_w(n) \cdot h_w(n - m_i) \tag{7}$$

where $X_w(n)$ represents an input signal with weighting coefficient integrated convolutedly as mentioned, and likewise $h_w(n-m_i)$ represents an impulse response with weighting coefficient integrated convolutedly, which is positioned in time lagging by $m_i$ from the time corresponding to the sampling number n. Then, N represents a final sampling number in the analysis frame. Further, if deterioration of the tone quality is allowed somewhat, then convolution by the weighting coefficient W(n) is unnecessary, and the above $X_w(n)$ and $h_w(n-m_i)$ can be represented by X(n) and $h(n-m_i)$ respectively.

Figure 2A:
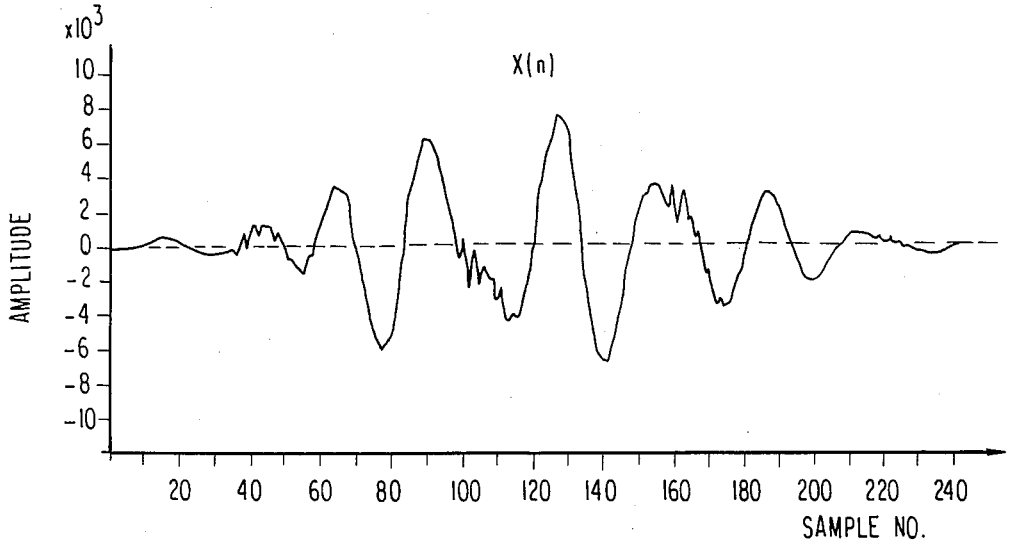

Specifically, $X_w(n)=X(n) \times W(n)$ and $h_w(n)=h(n) \times W(n)$ are calculated first in the $\phi_{hx}$ calculator 11, and the cross-correlation function $\phi_{hx}(m_i)$ at the time lag $m_i$ between $X_w(n)$ and $h_w(n)$ is obtained according to the expression (7). The relation of $X_w(n)$, $h_w(n)$ and $\phi_{hx}(m_i)$ will be described with reference to the waveform drawings of FIGS. 2A to 2D. FIGS. 2A, 2B and 2C represent the input waveform X(n) in one analysis frame which is subjected to window processing, the waveform $X_w(n)$ obtained through weighting the X(n) with an aural weighting function W(n) ($\gamma=0.8$), and the impulse response $h_w(n)$. FIG. 2D represents the $\phi_{hx}(m_i)$ obtained through the expression (7) by means of $X_w(n)$ and $h_w(n)$ indicated by FIGS. 2B and 2C with $m_i$ on the quadrature axis. An amplitude portion of the impulse response $h_w(n)$ shown in FIG. 2C is normally short as compared with the analysis frame length. Therefore, that amplitude portion appearing after the effective amplitude component, is assumed to be zero and neglected. An arithmetic operation on the $\phi_{hx}$ calculator 11 is carried out by shifting the relative time of FIG. 2B and FIG. 2C within a predetermined range (for one analysis frame length or so). The $\phi_{hx}(m_i)$ thus obtained is sent to an excitation source generator 16.

An autocorrelation function $R_{hh}$ calculator 15 calculates an autocorrelation function $R_{hh}(n)$ of the impulse response $h_w(n)$ from the h(n) calculator 14 according to $$R_{hh}(n) = \sum_{n=1}^{N} h_w(n) \cdot h_w(n) \tag{8}$$

and supplies it to the excitation source pulse generator 16. The $R_{hh}(n)$ thus obtained is shown in FIG. 2E. As in the case of h(n), a duration $N_R$ having an amplitude component effectively is determined in this case.

Since the number of multi-pulses calculated in the excitation source pulse calculator 16 is fixed in the conventional vocoder, the synthesized speech tone quality may deteriorate for the female voice or infant voice having short pitch period, as described hereinabove. In this invention, therefore, a multi-pulse number I calculated in the excitation source pulse calculator 16 is changed in accordance with the pitch period of the input speech.

That is, as is well known, a pitch extractor 17 calculates an autocorrelation function of the input sound signal at each analysis frame and extracts the time lag in a maximum autocorrelation function value as a pitch period $T_p$. The pitch period thus obtained is sent to a multi-pulse number I specifier 18. The I specifier 18 determines a value I, for example, through dividing an analysis frame length T by $T_p$ and specifies the value I as the number of multi-pulses to be calculated.

Then, the excitation source pulse calculator 16 calculates the similarity, as described below, by means of the cross-correlation function $\phi_{hx}(m_i)$ and the autocorrelation function $R_{hh}(n)$, and obtains the maximum value and the time position thereat in sequence, thus securing the time position and the amplitude value of I pieces of the multi-pulse as $g_1(m_1)$, $g_2(m_2)$, $g_3(m_3)$, . . . , $g_I(m_I)$.

Specifically, as shown in FIG. 3, $\phi_{hx}(m_i)$ from the $\phi_{hx}$ calculator 11 is first stored temporarily in a $\phi_{hx}$ memory 161. In $R_{hh}$ normalizer 162, a normalization coefficient a which corresponds to a power in the $R_{hh}$ waveform as shown in FIG. 2E is obtained from $R_{hh}(n)$, received from the $R_{hh}$ calculator 15, through the following expression:

$$a = R_{hh}^2(0) + 2\sum_{x=1}^{N_R} R_{hh}^2(S) \tag{9}$$

where $N_R$ indicates an effective duration of the impulse response h(n). Further, the $R_{hh}$ normalizer 162 normalizes $R_{hh}(n)$ with a, and a normalized autocorrelation function $R'_{hh}(n)$ is stored in $R'_{hh}$ memory 163.

A similarity calculator 164 develops a product sum $b_{mi}$ of $\phi_{hx}$ and $R_{hh}'$ as a similarity around the lag $m_i$ of $\phi_{hx}$ through the following expression:

$$b_{mi} = \sum_{s=-N_R}^{N_R} \phi_{hx}(m_i + S) \cdot R'_{hh}(S) \tag{10}$$

The $b_{mi}$ thus obtained sequentially for each $m_i$ is supplied to a maximum value retriever 165.

The maximum value retriever 165 retrieves a maximum absolute value of the supplied $b_{mi}$, determines the time lag $\tau_1$ and the amplitude (absolute value) $b_{\tau 1}$, and sends it to a multi-pulse first memory 166 and $\phi_{hx}$ corrector 167 as the pulse first determined of the multi-pulses.

The $\phi_{hx}$ corrector 167 corrects the $\phi_{hx}(m_i)$ supplied from the $\phi_{hx}$ memory 161 around the lag $\tau_1$ by means of $R_{hh}$ from the $R_{hh}$ calculator 15 and amplitude $b_{\tau 1}$ according to the expression (11):

$$\phi_{hx}(\tau_1 + m_i) = \phi_{hx}(\tau_1 + m_i) - b_{\tau i} \cdot R_{hh}(n) \tag{11}$$

where $m_i$ indicates a correction interval. The corrected $\phi_{hx}$ is stored in the $\phi_{hx}$ memory in the place of $\phi_{hx}$ stored therein at the same time position as the corrected $\phi_{hx}$. Next, the similarity of the corrected $\phi_{hx}$ and $R_{hh}'$ is obtained, the maximum value $b_{\tau 2}$ and the time position thereat (sampling number) $\tau_2$ are obtained, then they are supplied to the multi-pulse memory 166 as the second pulse and to the $\phi_{hx}$ corrector 167 for $\phi_{hx}$ correction similar to the above. Thus $\phi_{hx}$ stored in the $\phi_{hx}$ memory 161 and corresponding thereto is rewritten thereby. A similar processing is repeated thereafter to determine multipulses up to the I-th pulse. The multi-pulse thus determined is stored temporarily in the multi-pulse memory 166 and then sent to the transmission line 101 by way of the encoder 19 and the multi-plexer 20.

As described above, in the invention, since $R_{hh}'$ multiplied by a proper weighting coefficient is subtracted for the suitable portion of $\phi_{hx}$, the residual is decreased most efficiently. Specifically, the product sum $b_{mi}$ of $\phi_{hx}$ and $R_{hh}'$ is obtained through the expression (11), and the maximum value of $b_{mi}$ and the time positions $b_{\tau i}$ and $\tau_i$ are obtained for the i-th multi-pulse. The multi-pulse is determined similarly to the above processing according to $\phi_{hx}$ obtained through correction by means of the above $b_{\tau i}$. Here, an amplitude of the multi-pulse is preferred at $b_{\tau i}$ because of the following:

With reference to FIG. 4, let it be assumed that the residual of $\phi_{hx}$ is minimized when impulse (expressed by $V \cdot R_{hh}$) of an amplitude V is impressed at $m_l (l = 1)$. Then, the product sum of the impulse $V \cdot R_{hh}$ and $R_{hh}$ will be:

$$\begin{aligned} B_{ml(l-1)} &= \sum_{s=-N_R}^{N_R} V \cdot Rhh(S) \cdot Rhh(S) \\ &= V(R_{hh})(0) + 2\sum_{s=1}^{N_R} R_{hh}(S)) \\ &= aV \end{aligned} \tag{12}$$

where a represents the value obtained through the expression (9). Therefore, V represents a value obtained through dividing $B_{ml(l=1)}$ by normalization coefficient a.

Now, there is a relation, holding:

$$\begin{aligned} \frac{B_{mj}}{a} &= \frac{1}{a}\sum_{s=-N_R}^{N_R} v \cdot R_{hh}(S) \cdot R_{hh}(S) \\ &= \frac{1}{a}\sum_{s=-N_R}^{N_R} \phi_{hx}(m_j + S) \cdot R_{hh}(S) \\ &= \sum_{s=-N_R}^{N_R} \phi_{hx}(m_j + S) \cdot \frac{R_{hh}(S)}{a} \\ &= \sum_{s=-N_R}^{N_R} \phi_{hx}(m_j + S) \cdot R'_{hh}(S) \end{aligned} \tag{13}$$

Therefore, an amplitude of the multi-pulse is determined as a maximum value of the product sum of $\phi_{hx}$ and $R_{hh}'$.

Various means other than the product sum are available for producing the similarity in this embodiment. For example, $C_{mi}$ maximizing a magnitude at the lag $m_i$ of $\phi_{hx}$ and $R_{hh}$ is calculated through the following expression (14), and then the $m_i$ whereat the magnitude at each lag is minimized, or the similarity is maximized can be retrieved.

$$C_{mi} = \min \sum_{s=-N_R}^{N_R} |\phi_{hx}(m_i + S) - C_{mi} \cdot R_{hh}(S)| \tag{14}$$

In case magnitude is used for the similarity, the $R_{hh}$ normalizer 162 is not necessary. Further, the K parameter is used for spectrum information in this embodiment, however, another parameter of the LPC coefficient, such as the $\alpha$ parameter, for example, can be utilized. An all-zero type digital filter instead of the all-pole type can also be used for the LPC synthesis filter.

FIGS. 5A to 5K show the above-mentioned process according to a change in the waveform. Here, the multi-pulse number specified in the I specifier 18 is given as I.

Figure 5A:
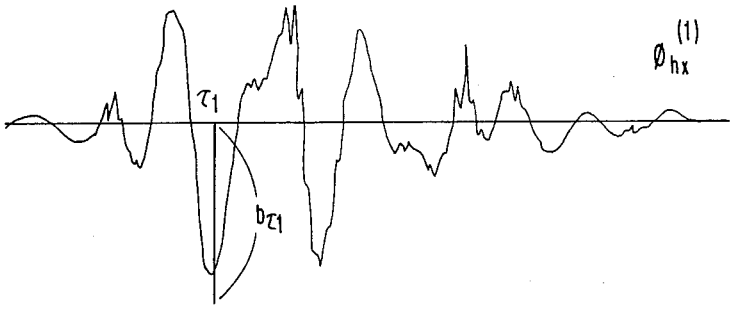
FIGS. 5A to 5K are waveform drawings representing a cross-correlation function $\phi_{hx}$ calculated successively for use as basic information when the multi-pulse is determined using the teachings of this invention.
Figure 5B:
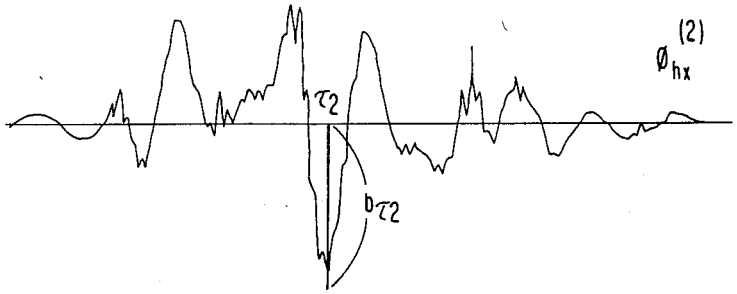
Figure 5C:
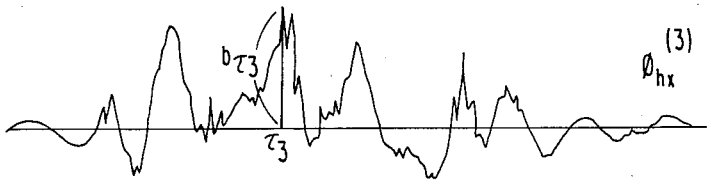
Figure 5D:
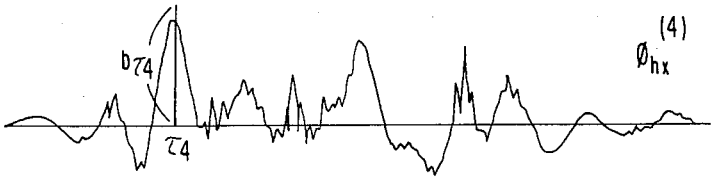
Figure 5E:
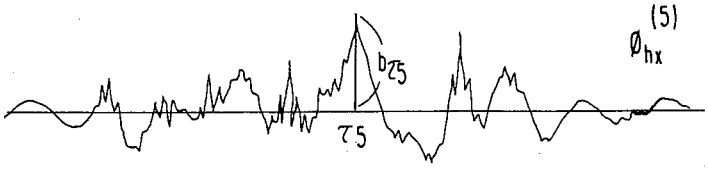
Figure 5F:
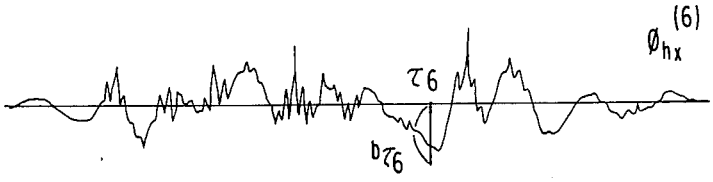
Figure 5G:
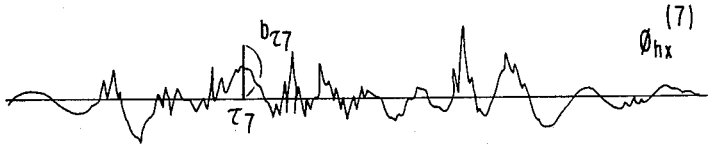
Figure 5H:
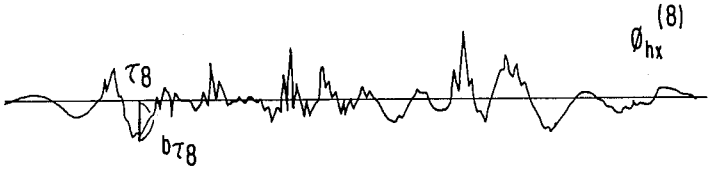
Figure 5I:
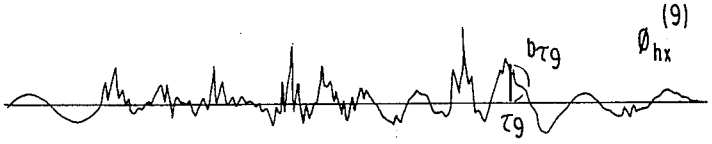
Figure 5J:
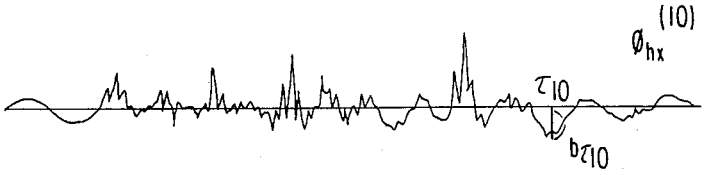
Figure 5K:
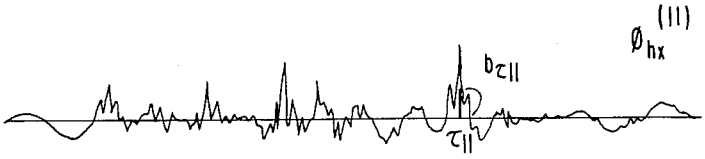

First, the time position (sampling number) $\tau_1$ whereat a similarity of $\phi_{hx}^{(1)}$ for which no correction has been applied is shown in FIG. 5A and $R_{hh'}$ is maximized and the amplitude value $b_{\tau 1}$ are obtained as the first multi-pulse. The waveform of $\phi_{hx}^{(1)}$ corrected by means of $b_{\tau 1}$ thus obtained according to the expression (11) is $\phi_{hx}^{(2)}$ shown in FIG. 5B. Next, a similarity of $\phi_{hx}^{(2)}$ and $R_{hh'}$ is obtained, and a time position $\tau_2$ whereat the similarity is maximized and the maximum value $b_{\tau 2}$ are determined as the second multi-pulse. FIG. 5C represents a cross-correlation function $\phi_{hx}^{(3)}$ obtained through correcting $\phi_{hx}^{(2)}$ by means of $b_{\tau 2}$ according to the expression (11), and an amplitude $b_{\tau 3}$ and a time position $\tau_3$ of the third multi-phase are determined likewise. FIGS. 5D to 5K represent waveforms of $\phi_{hx}^{(4)}$ to $\phi_{hx}^{(11)}$ corrected after each multi-pulse is determined as described, and amplitude values $b_{\tau 4}$ to $b_{\tau 11}$ and time positions $\tau_4$ to $\tau_{11}$ of the fourth to eleventh multi-pulses are obtained from each waveform.

According to a conventional process, a peak value of $\phi_{hx}$ and the time position coincide with those of a determined multi-pulse, however, they do not necessarily coincide with each other in this invention. This is conspicuous particularly in FIGS. 5F, 5H and 5K. The reason is that determination of a new multi-pulse is based on similarlity, and an influence of the pulse determined prior thereto is decreased most favorably by the entire residual of the waveforms.

FIG. 6 represents a measured example comparing S/N ratio of the output speeches on the basis of an input speech with one input speed determined in accordance with the teachings of this invention. As will be apparent therefrom, the S/N ratio is improved and the coding efficiency is also enhanced according to this invention as compared with a conventional correlation procedure.

Referring to FIG. 7, information $g_i(m_i)$ and K parameters coming through the transmission line 101 are decoded in decoders 31 and 32 and supplied to LPC synthesizer 33 as excitation source information and spectrum information after being passed through a demultiplexer 30 on the synthesis side. As is well known, the LPC synthesizer 33 consists of a digital filter such as recursive filter or the like, has the weighting coefficient controlled by K parameters ($K_1$ to $K_p$), excited by the multi-pulse $g_i(m_i)$ and thus outputs a synthesized sound signal X(n). The output X(n) is smoothed through a low-pass filter (LPF) 34 and then sent to an output terminal 102.

What is claimed is:

1. A multi-pulse type vocoder comprising:

first means for extracting spectrum information of an input speech signal X(n) in an analysis frame;

second means for developing an impulse response h(n) of a filter specified by said spectrum information;

third means for developing a cross-correlation series $\phi_{hx}$(mi) between said input speech signal X(n) and said impulse response h(n) at a time lag mi within a predetermined time range, n representing a sampling time point;

fourth means for developing an auto-correlation series $R_{hh}(n)$ of said impulse response h(n) and a normalized auto-correlation series $R_{hh,(n)}$ normalized by a power of the auto-correlation series $R_{hh(n)}$;

fifth means for determining the most similar portion of said cross-correlation series $\phi_{hx}$ to the auto-correlation series $R_{hh(n)}$;

sixth means for developing a similarity between the cross-correlation series $\phi_{hx(n)}$ and the normalized auto-correlation series $R_{hh'(n)}$; and seventh means for providing a pulse having the maximum similarity value and a time position thereat of the most similar portion of said cross-correlation series $\phi_{hx}$ as one of said multi-pulses.

2. The multi-pulse type vocoder as defined in claim 1, further comprising eighth means for correcting said cross-correlation series $\phi_{hx}$ by subtracting a weighted auto-correlation series by the maximum similarity from the most similar portion of said cross-correlation series and providing the corrected cross-correlation series to said fifth means.

3. The multi-pulse type vocoder as defined in claim 1, wherein said first means includes means for extracting a linear prediction parameter.

4. The multi-pulse type vocodor as defined in claim 1, wherein said first means includes means for weighting said input speech signal and extracting the spectrum information from the weighted input speech signal.

5. The multi-pulse type vocoder as defined in claim 1, wherein said sixth means includes a similarity calculator calculating the similarity $b_{mi}$ according to the following expression:

$$b_{mi} = \sum_{S=-NR}^{NR} \phi_{hx}(m_i + S) \cdot R'_{hh}(S)$$

where S represents time point; $m_i$, time point shifted from the S; and $N_R$, predetermined effective duration time of the normalized autocorrelation series $R_{hh'(S)}$.

6. The multi-pulse type vocoder as defined in claim 1, wherein said sixth means includes a similarity calculator calculating the similarity $C_{mi}$ according to the following expression:

$$C_{mi} = \min \sum_{S=-NR}^{NR} |\phi_{hx}(m_i + S) - C_{mi} \cdot R_{hh}(S)|$$

where S represents time point; $m_i$, time point shifted from the S; and $N_R$, a predetermined effective duration time of the normalized auto-correlation series $R_{hh'(S)}$.

7. The multi-pulse type vocoder as defined in claim 1, wherein said first means includes means for extracting a pitch of said input speech signal and supplying the pitch to said sixth means to determine the total number of multi-pulses to be provided.

8. The multi-pulse type vocoder as defined in claim 1, wherein said seventh means includes means for determining a quotient obtained by dividing said analysis frame period by said pitch period as the total number of multi-pulses.

9. The multi-pulse type vocoder as defined in claim 1, further comprising a synthesis filter operable by the spectrum information from said first means and the multi-pulses from said sixth means.

* * * * *

UNITED STATES PATENT AND TRADEMARK OFFICE

CERTIFICATE OF CORRECTION

PATENT NO. : 4,720,865

DATED : January 19, 1988

INVENTOR(S) : TAGUCHI

It is certified that error appears in the above-identified patent and that said Letters Patent is hereby corrected as shown below:

COLUMN 2, LINE 33 Delete "x(n)" and insert

--$\tilde{x}(n)$--;

COLUMN 2, LINE 49 Delete "x(n) and x(n)" and insert

--x(n) and $\tilde{x}(n)$--;

COLUMN 2, LINE 51 equation 3, Delete "$e_w(n) = \{x(n) - x(n)\}w(n)$" and insert --$e_w(n) = \{x(n) - \tilde{x}(n)\} * w(n)$--;

COLUMN 2, LINE 57 equation 4, Delete

" $\sum_{n=1}^{N} e^2_w(n) = \sum_{n=1}^{N} [\{x(n) - \tilde{x}(n)\} w(n)]^2$ "

and insert

— $\sum_{n=1}^{N} e^2_w(n) = \sum_{n=1}^{N} [\{x(n) - \tilde{x}(n)\} * w(n)]^2$ —

COLUMN 3, LINE 8 Delete "x(n) x w(n)" and insert

--x(n) * w(n)--;

UNITED STATES PATENT AND TRADEMARK OFFICE

CERTIFICATE OF CORRECTION

PATENT NO. : 4,720,865

DATED : January 19, 1988

INVENTOR(S) : TAGUCHI

It is certified that error appears in the above-identified patent and that said Letters Patent is hereby corrected as shown below:

COLUMN 3, LINE 9 Delete "h(n)x w(n)" and insert --h(n) x w(n)--;

COLUMN 6, LINE 5 Delete "$h(4)=a_4 + a_3 \cdot h(1) + a_2 \cdot h(2) + ah(3)$" and insert --$h(4) = a_4 + a_3 \cdot h(1) + a_2 \cdot h(2) + a_1 \cdot h(3)$--;

COLUMN 6, LINE 28 Delete "$X_w(n) = X(n) \times W(n)$" and insert --$X_w(n) = S(n) \times W(n)$--;

COLUMN 6, LINE 28 Delete "$h_w(n) = h(n)$ x" and insert --$h_w(n) = h(n)$ x--;

COLUMN 8, LINES 48 and 49, equation 13, Delete

" $= \sum_{s=-N_R}^{N_R} \phi_{hx}(m_j + S) \cdot R'_{hh}(S)$ "

and insert

— $= \sum_{s=-N_R}^{N_R} \phi_{hx}(m_j + S) \cdot R_{hh}'(S)$ —

UNITED STATES PATENT AND TRADEMARK OFFICE

CERTIFICATE OF CORRECTION

PATENT NO. : 4,720,865

DATED : January 19, 1988

INVENTOR(S) : TAGUCHI

It is certified that error appears in the above-identified patent and that said Letters Patent is hereby corrected as shown below:

COLUMN 9, LINE 56 Delete "signal X(n) The output X(n)" and insert --signal $\tilde{x}(n)$ The output $\tilde{x}(n)$--

COLUMN 10, LINE 48 Delete

" $C_{mi} = \min \sum_{S=-NR}^{NR} |\phi_{hx}(m_i + S) - C_{mi} \cdot R_{hh}(S)|$ "

and insert $$-- \; C_{mi} = \min \sum_{S=-N_p}^{NR} \left| \Phi_{hx} (m_i + S) - C_{mi} \cdot R_{hh}(S) \right| \; --$$

Signed and Sealed this

Twentieth Day of December, 1988

*Attest:*

DONALD J. QUIGG

*Attesting Officer*

*Commissioner of Patents and Trademarks*